US006846998B2

(12) United States Patent
Hasumi et al.

(10) Patent No.: US 6,846,998 B2
(45) Date of Patent: Jan. 25, 2005

(54) SWITCH CONNECTING STRUCTURE FOR TIMEPIECE

(75) Inventors: Takayuki Hasumi, Niza (JP); Shinichi Yamada, Tokyo (JP); Kenji Shimoda, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 10/349,100

(22) Filed: Jan. 23, 2003

(65) Prior Publication Data

US 2003/0143897 A1 Jul. 31, 2003

(30) Foreign Application Priority Data

Jan. 28, 2002 (JP) ..... 2002-017889

(51) Int. Cl.[7] ..... G04B 29/00
(52) U.S. Cl. ..... 200/341; 368/321
(58) Field of Search ..... 200/341, 520, 200/320.2; 368/328, 320, 321; 968/447, 450; 439/862

(56) References Cited

U.S. PATENT DOCUMENTS 4,007,347 A * 2/1977 Haber ..... 200/530
4,062,181 A * 12/1977 Zurcher ..... 708/111
4,130,986 A * 12/1978 Ramet ..... 368/224
6,334,706 B1 * 1/2002 Meyrat et al. ..... 368/321
6,494,615 B2 * 12/2002 Wyssbrod ..... 368/319

FOREIGN PATENT DOCUMENTS

JP 55-128185 10/1980
JP 7-5270 1/1995

* cited by examiner

*Primary Examiner*—Neil Abrams
(74) *Attorney, Agent, or Firm*—Dickstein Shapiro Morin & Oshinsky LLP

(57) ABSTRACT

An inexpensive switch connecting structure is provided capable of avoiding abnormal wear-off or deformation of a contact spring of a supporting plate even if a movement in a basic shape is placed in a timepiece case having a shape different from the movement and a push button is repeatedly used. The switch connecting structure includes a supporting plate attached to cap a movement of a timepiece and provided with a contact spring having a contact portion at a tip brought into contact with a switch contact portion of a circuit board, and a switch regulating plate provided with a switch spring on an outer periphery corresponding to said contact spring and covering at least part of said supporting plate, wherein said switch spring is flexed by operation of an externally operated component attached to a timepiece case, thereby bringing the contact portion of the contact spring of said supporting plate into contact with the switch contact portion of said circuit board. The switch spring of the switch regulating plate acts as an intermediary to properly convey the pressing force from the externally operated component such as a push button attached to the timepiece case having a different shape from the basic shape of the movement.

5 Claims, 10 Drawing Sheets

FIG, 4

SWITCH CONNECTING STRUCTURE FOR TIMEPIECE

BACKGROUND OF THE INVENTION

1. Field of the Invention

The present invention relates to a switch connecting structure of a multifunctional electronic timepiece having an externally operated component.

2. Description of the Prior Art

In recent years, multifunctional electronic timepieces, such as watches provided with chronograph function and the like, have been commercially available in the market. Generally, in such a multifunctional electronic watch, a supporting plate is attached to substantially cap a planar portion of a basic circular movement, and is placed in a body of a watch case having substantially the same shape as the movement. In the switch connecting structure, depression of a push button, i.e. an externally operated component disposed at a predetermined position of the body of the case, causes a contact spring provided on the supporting plate to contact a switch contact on a circuit board, thereby electrically connecting to elements of electronic components provided in the movement.

Since the basic movement and the watch case are substantially in the same shape as described above, the pressing force of the push button is applied in the substantially central direction of the movement, and therefore the contact spring of the supporting plate is not worn off or deformed.

However, with the diversified customer needs in the market, there is a demand for watch cases in different shapes, such as a square case. Therefore, the basic circular movement is required to be placed in a square watch case rather than producing a new square movement.

FIG. 10 is a plan view illustrating an important part of a watch around a push button where a circular movement is placed in a square watch case. Referring to FIG. 10, a movement 1 includes a bottom plate, which is a base of the watch, receiving components supporting a train of various gears, and electronic components such as a quartz oscillator, electric elements, and an IC chip, mounted thereon. A circuit board 2 includes a wiring pattern for electrically connecting various elements of the electronic components, and a switch contact portion 2*a* provided on part of a side wall thereof. A supporting plate 3 is formed to substantially cap the planar portion of the movement 1. On the outer periphery of the supporting plate 3, one or more contact springs 3*a* of the same number as the push button 4 are formed at a position corresponding to the push button 4.

The push button 4 is provided to fit in the body of a square watch case 5 at a predetermined position. The basic circular movement 1 is attached to the square watch case 5 without any modification by placing the movement 1 capped by the supporting plate 3 into the body of the watch case 5. A stem 7 is used for common adjustment operation.

In the switch connecting structure described above, when a depressed portion 4*a* of the push button 4 is operated, an abutment portion 4*b* provided at a tip of the push button 4 presses down the contact spring 3*a* of the supporting plate 3 to bring a contact portion 3*b* at a tip thereof into contact with a switch contact portion 2*a* formed at the circuit board 2, thereby electrically connecting to various elements of the electronic components mounted on the movement 1.

However, in the conventional switch connecting structure described above, the pressing force of the push button 4 does not act in the central direction of the movement 1 because the basic circular movement 1 is placed in the square watch case 5 having a different shape. As a result, the depression portion 4*b* of the push button 4 and the switch spring 3*a* are brought into a point contact in a diagonal direction. Consequently, depression of the push button 4 results in abnormal wear-off or deformation of the contact spring 3*a* of the supporting plate. Therefore, repeated use of the push button 4 causes an unstable contact between the contact portion 3*b* of the supporting plate 3 and the switch contact portion 2*a* of the circuit board 2, possibly leading to a bad contact, abnormal wear-off or deformation. Further, as the distance between the push button 4 and the contact spring 3*a* is increased, the push button 4 having an extended longitudinal portion up to the abutment portion 4*b* is required. The push button 4 may be deformed during processing of the button, and extra material is required, leading to an increase in manufacturing cost.

An object of the present invention is to solve the above-described problems, and to provide an inexpensive switch connecting structure capable of avoiding abnormal wear-off or deformation of a contact spring of a supporting plate even if a movement in a basic shape is placed in a timepiece case having a shape different from the movement and a push button is repeatedly used.

SUMMARY OF THE INVENTION

In order to solve the above-described problems, a switch connecting structure according to the present invention comprises a supporting plate attached to cap a movement of a timepiece and provided with at least one or more contact springs having a contact portion at a tip brought into contact with a switch contact portion of a circuit board, and a switch regulating plate provided with at least one or more switch springs on an outer periphery corresponding to said contact springs, and covering at least part of said supporting plate, wherein said switch spring is flexed by operation of an externally operated component attached to a timepiece case, thereby bringing the contact portion of the contact spring of said supporting plate into contact with the switch contact portion of said circuit board. The switch spring of the switch regulating plate acts as an intermediary to properly convey the pressing force from an externally operated component such as a push button attached to the timepiece case having a different shape from the basic shape of the movement.

A switch connecting structure having a plurality of switch springs disposed symmetrically on the outer periphery of the switch regulating plate can allow a movement of a timepiece having the supporting plate provided with a plurality of contact springs to fit in a timepiece case having a different shape, and prevent abnormal wear-off or deformation of the contact spring.

A switch connecting structure provided with a plurality of hook portions hooking onto the movement of the timepiece and disposed on the outer periphery of the switch regulating plate makes it possible to hook the switch regulating plate onto the movement of the timepiece and fix the position of the plate with respect to the movement, thereby allowing the plate to be handled together with the movement.

When the switch spring of the switch regulating plate extends substantially in parallel to a inside wall of a body of said timepiece case and has a round portion where it contacts said contact spring, the pressing force of the push button is applied in the substantially vertical direction to the tip of the switch regulating plate, and the force of the switch regulating plate is applied on the supporting plate in the substantially central direction of the movement. As a result, the tip portion of the push button can be brought into a line contact with the contact spring of the supporting plate, and the switch spring of the switch regulating plate can be brought into a line contact at the round portion with the contact portion of the contact spring of the supporting plate, thereby avoiding abnormal wear-off or deformation of the contact spring.

When the switch spring of the switch regulating plate extends substantially in parallel to a inside wall of a body of the timepiece case and has a corner extending substantially in parallel to the contact spring and provided at a position where it contacts the contact spring, the pressing force of the push button is applied in the substantially vertical direction to the tip portion of the switch regulating plate, and the force of the switch regulating plate is applied on the supporting plate in the substantially central direction of the movement. As a result, the tip portion of the push button can be brought into a line contact with the contact spring of the supporting plate, and the switch spring of the switch regulating plate can be brought into a line contact with the contact spring of the supporting plate at the corner portion extending in parallel, thereby avoiding abnormal wear-off or deformation of the contact spring.

DESCRIPTION OF THE PREFERRED EMBODIMENTS

Figure 1:
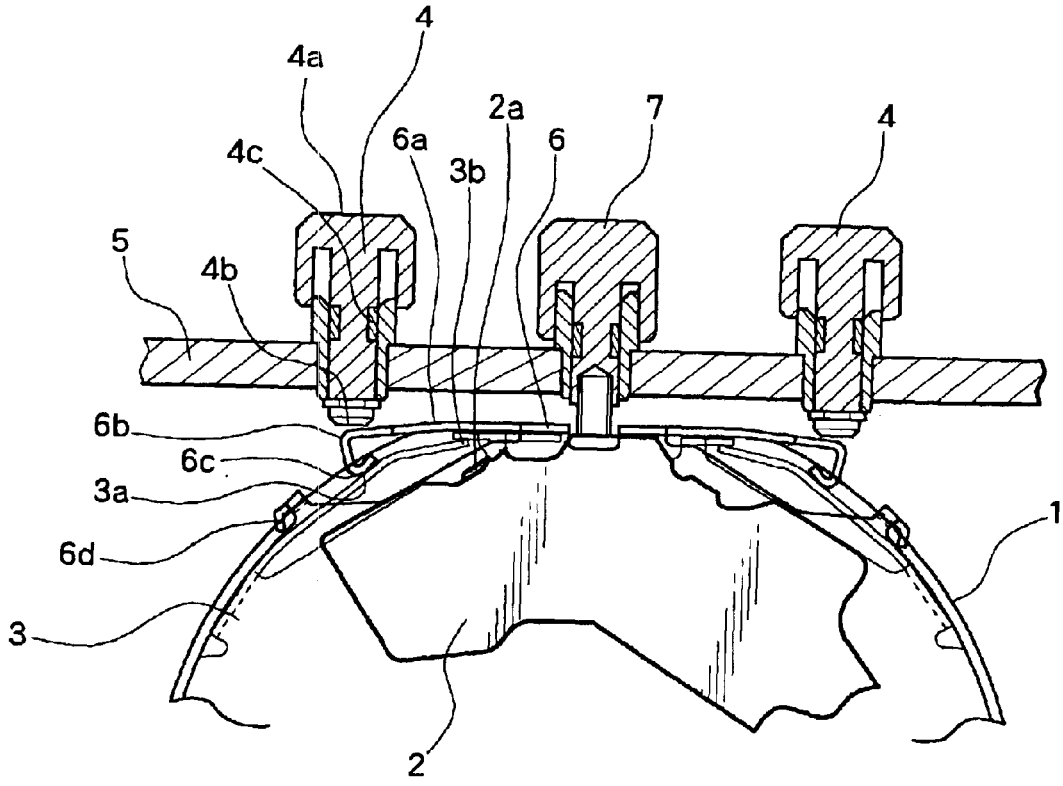
FIG. 1 is a plan view illustrating an important part of a switch connecting structure of the present invention when a circular movement is placed in a square watch case according to a first embodiment. A push button and the case are illustrated in cross section.
Figure 2:
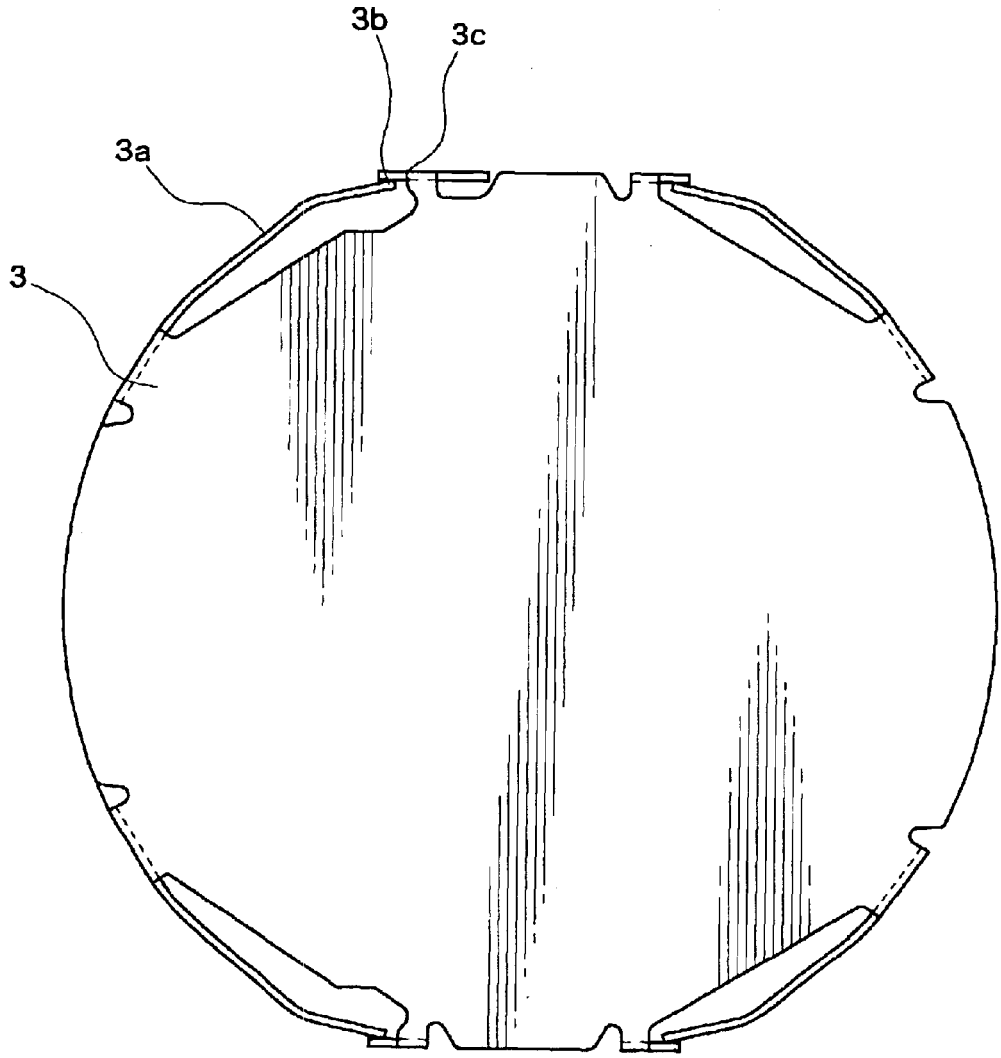
FIG. 2 is a plan view illustrating a supporting plate used in the first embodiment.
Figure 3:
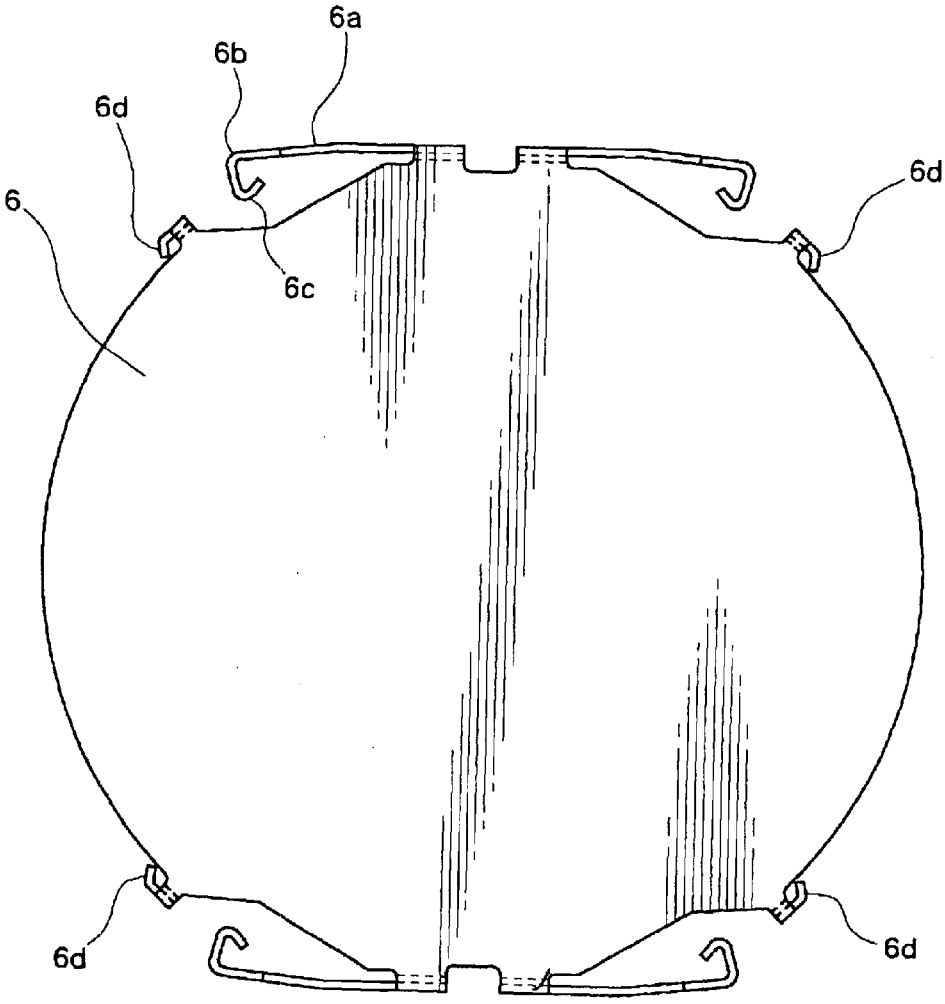
FIG. 3 is a plan view illustrating a switch regulating plate used in the first embodiment.
Figure 4:
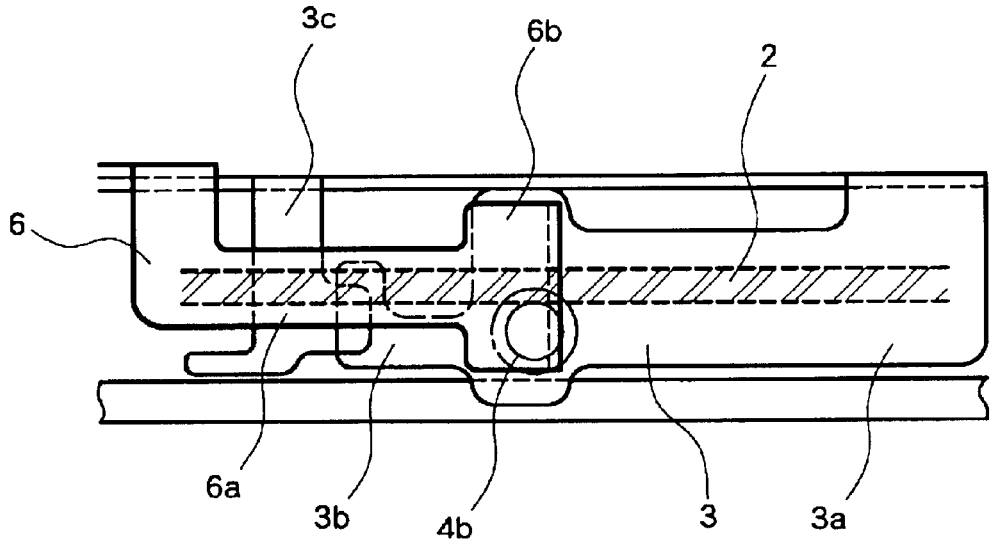
FIG. 4 is a side view illustrating how a movement assembly is disposed in the first embodiment.
Figure 10:
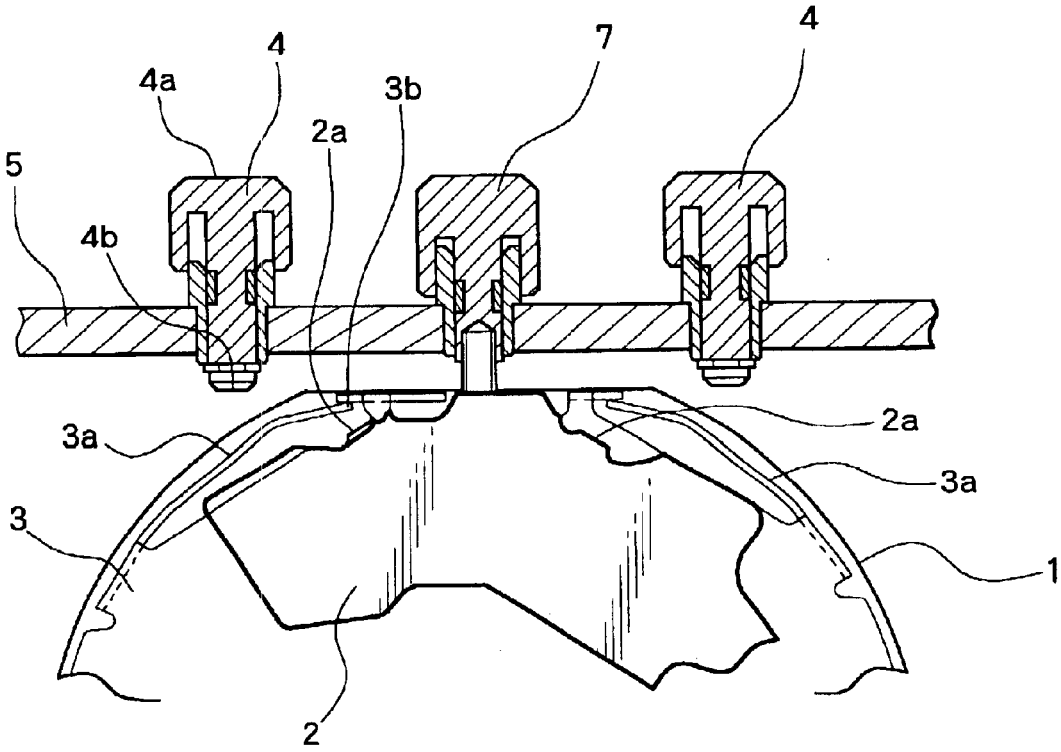
FIG. 10 PRIOR ART
FIG. 10 is a plan view illustrating an important part of a conventional switch connecting structure when a circular movement is placed in a square watch case.

A switch connecting structure according to the present invention will be described with reference to the drawings. FIGS. 1–4 illustrate a first embodiment of a switch connecting structure according to the present invention in which a circular movement is placed in a square watch case. FIG. 1 is a plan view illustrating an important part. A push button and a case are shown in cross section. FIG. 2 is a plan view of a supporting plate. FIG. 3 is a plan view of a switch regulating plate. FIG. 4 is a side view illustrating how a movement assembly is disposed. The components corresponding to those in the related art (illustrated in FIG. 10) are labeled with the corresponding numerals and characters.

A circular movement 1 is capped by a supporting plate 3 illustrated in FIG. 2. A contact spring 3*a* is suspended from the body of the supporting plate 3 on the outer periphery of the plate 3, extending around the movement and having a contact portion 3*b* at the tip. The tip contact portion 3*b* abuts a restricting portion 3*c* suspended from the body of the supporting plate 3, thereby preventing the supporting plate 3 from springing out. The contact springs 3*a* are provided along the outer periphery of the supporting plate 3 at four locations in this example in a substantially symmetrical manner. The supporting plate 3 is fixed to the movement by screwing, adhesive bonding, or the like. The switch regulating plate 6 illustrated in FIG. 3 is attached to cap the substantially entire surface of the supporting plate 3. The switch regulating plate 6 is provided with a switch spring 6*a* suspended therefrom at a position along the outer periphery corresponding to the contact spring 3*a* of the supporting plate 3.

The switch spring 6*a* provided at the switch regulating plate 6 extends substantially in parallel to a inside wall of the body of a watch case 5, and a tip 6*b* of the plate 6 is curved inward substantially in the "U" shape near a position where it contacts the abutment portion 4*b* of a push button 4 when the push button 4 is operated. At a position extended from and facing the tip portion 6*b*, a round portion 6*c* roundly curved is formed. The switch regulating plate 6 is provided with a plurality (four in FIG. 3) of hook portions 6*d* hooking onto the movement of the watch and substantially equally spaced apart from one another on the outer periphery thereof. As illustrated in FIG. 4, the contact spring 3*a* suspended from the supporting plate 3 mounted on the movement of the watch is located to be level with the movement having the circuit board 2, and extends in parallel thereto. The switch regulating plate 6 is disposed over and covers the supporting plate 3, hooked onto the movement of the watch by the hook portion 6*d*. In the plan view as illustrated in FIG. 1, the contact portion 3*b* at the tip of the supporting plate 3 is disposed to face the switch contact portion 2*a* of the circuit board 2, the round portion 6*c* extending from the tip portion 6*b* of the switch regulating plate 6 is disposed so as to abut a central portion of the contact spring 3*a* of the supporting plate 3, and an externally operated component, i.e. the abutment portion 4*b* at the tip of the push button in this example, is disposed so as to abut the tip portion 6*b* of the switch regulating plate 6.

Functions and effects of the above first embodiment will next be described. When the depression portion 4*a* of a desired push button 4 is pressed, the abutment portion 4*a* at the tip of the push button 4 first presses substantially vertically down the tip portion 6*b* of the switch regulating plate 6, and the round portion 6*c* curved to face the tip portion 6*b* presses down the contact spring 3*a* of the supporting plate 3 in the substantially central direction of the movement 1. The contact portion 3*b* at the tip of the supporting plate 3 is brought into contact with the switch contact portion 2*a* provided at the circuit board 2. The above-described operation of the push button 4 causes an electrical connection with various elements of the electronic components mounted on the movement 1.

Figure 9:
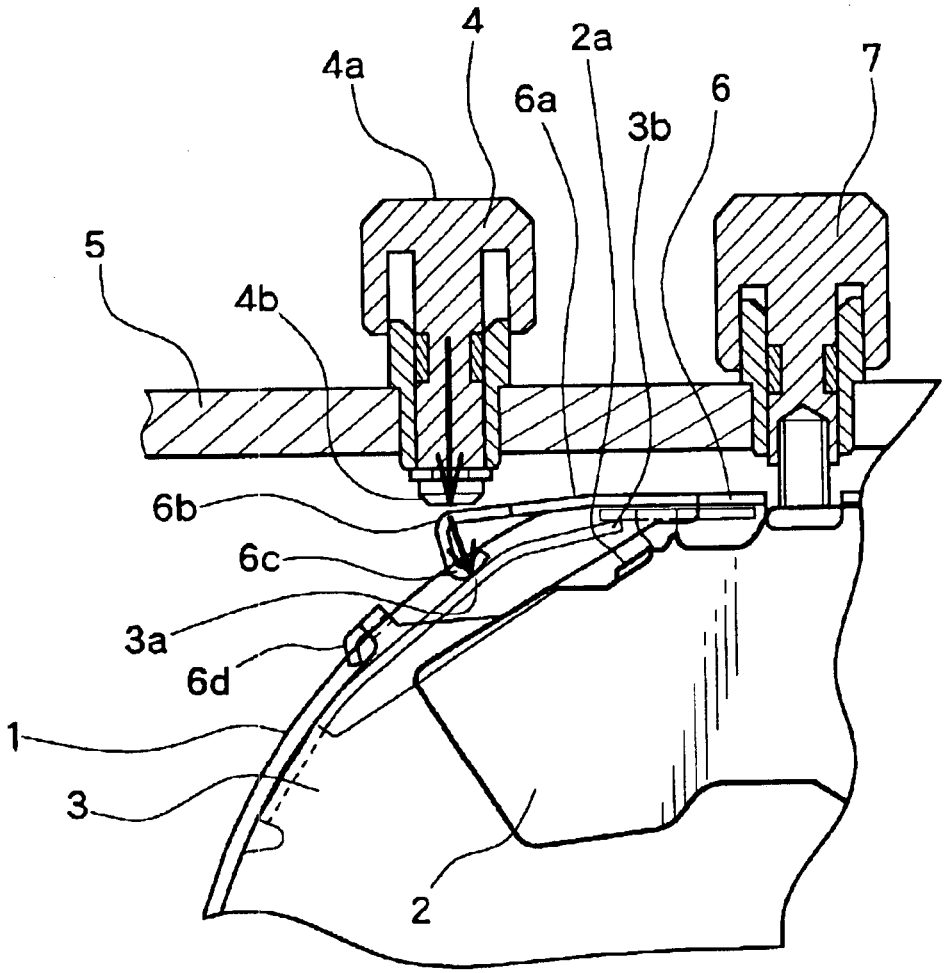
FIG. 9 is a plan view for describing how the pressing force of a push button is conveyed in the first embodiment illustrated in FIG. 1.

FIG. 9 is a plan view for describing how the pressing force of the push button is conveyed in the first embodiment illustrated in FIG. 1. As indicated by arrows, the pressing force of the push button 4 acts in the substantially vertical direction on the tip portion 6*b* of the switch regulating plate 6, and the force is applied from the switch regulating plate 6 to the supporting plate 3 in the substantially central direction of the movement 1, thereby avoiding the problem in the related art, i.e. abnormal wear-off or deformation of the contact spring 3*a* of the supporting plate caused by the tip portion of the push button slidingly contacting at a point with the contact spring of the supporting plate when the push button 4 is repeatedly pressed. As a result, reliability of electrical connection can be improved.

As the plurality of hook portions 6*d* are disposed substantially equally spaced apart on the outer periphery of the switch regulating plate 6, accurate attachment of the switch regulating plate 6 to the supporting plate 3 is ensured without any troublesome fixing operations such as screwing. Further, as the hook portion 6*d* makes it possible to hold the switch regulating plate 6 more stably, depression of the push button 4 can be surely performed without lifting the switch regulating plate 6.

Further, by simply supplying the switch regulating plate 6 to a customer, he/she can easily place the basic circular movement 1 into a desired square watch case 5.

As described above, use of the switch regulating plate enables easy placement of the basic circular movement into the square watch case having a different shape. Further, repetitive use of the push button does not cause abnormal wear-off or deformation of the contact spring of the supporting plate. Thus, an inexpensive switch connecting structure with excellent reliability can be provided.

Figure 5:
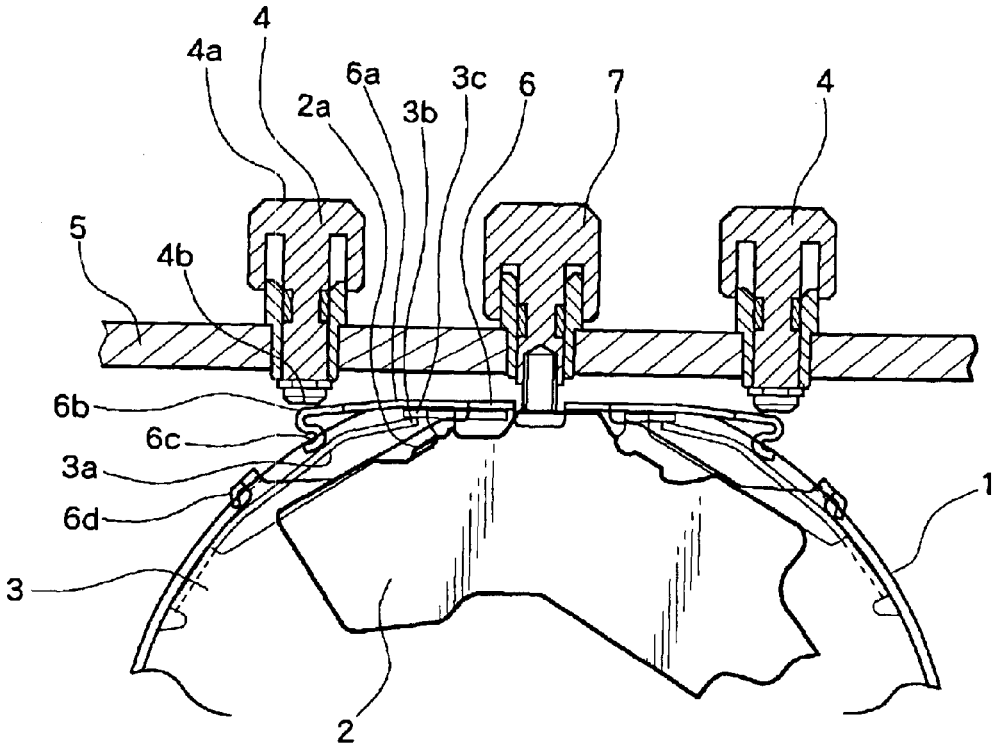
FIG. 5 is a plan view illustrating an important part of a switch connecting structure of the present invention when a circular movement is placed in a square watch case according to a second embodiment. This figure corresponds to FIG. 1.
Figure 6:
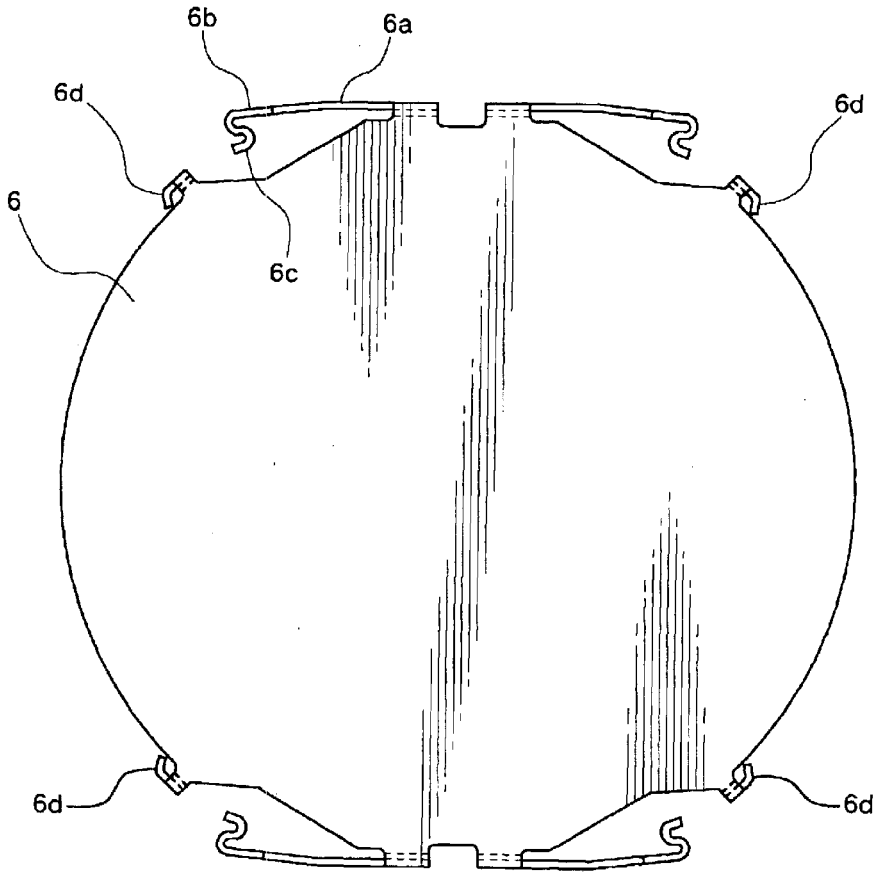
FIG. 6 is a plan view illustrating a switch regulating plate used in the second embodiment.

Next, a second embodiment of a switch connecting structure according to the present invention in which a circular movement is placed into a square watch case will be described with reference to FIGS. 5 and 6. FIG. 5 is a plan view illustrating an important part of the invention, and the push button and the case are shown in cross section as in FIG. 1. FIG. 6 is a plan view illustrating the switch regulating plate. The supporting plate similar to that described with reference to FIG. 2 in the first embodiment is employed in this embodiment.

The components corresponding to those in the related art (FIG. 10) and the first embodiment are labeled with the corresponding numerals and characters.

The supporting plate 3 illustrated in FIG. 2 is attached to cap the circular movement 1. On the outer periphery of the supporting plate 3, the contact spring 3*a* is suspended from the body of the supporting plate 3, extending around the movement and having the contact portion 3*b* at the tip. The tip contact portion 3*b* abuts the restricting portion 3*c* suspended from the body of the supporting plate 3, thereby preventing the supporting plate 3 from springing out. The contact springs 3*a* are formed at four locations in this example along the outer periphery of the supporting plate 3 in the substantially symmetrical manner. The supporting plate 3 is fixed to the movement by screwing, adhesive bonding, or the like. The switch regulating plate 6 is attached to cap the substantially entire surface of the supporting plate 3. At the outer peripheral location of the switch regulating plate 6 corresponding to the contact spring 3*a* of the supporting plate 3, the switch spring 6*a* is provided suspended therefrom.

The switch spring 6*a* provided at the switch regulating plate 6 extends substantially in parallel to a inside wall of the body of the watch case 5, and the tip portion 6*b* is curved inward in the "S" shape near the location where it contacts the abutment portion 4*b* of the push button 4 when the button 4 is pressed. The plate 6 is further provided with the round portion 6*c* having a round shape at the location further extended from the tip portion 6*b*. The switch regulating plate 6 is further provided with a plurality (four in FIG. 6) of hook portions 6*d* hooking onto the movement of the watch and disposed substantially equally spaced apart from one another on the outer periphery, suspended from the plate. The positional relations between these components in the vertical direction are the same as those in the first embodiment. In the plan view as illustrated in FIG. 5, the contact portion 3*b* at the tip of the supporting plate 3 is disposed facing the switch contact portion 2*a* of the circuit board 2, the round portion 6*c* extended from the tip portion 6*b* of the switch regulating plate 6 is disposed so as to abut the central portion of the contact spring 3*a* of the supporting plate 3, and an externally operated component, i.e. the abutment portion 4*b* at the tip of the push button in this example, is disposed so as to abut the tip portion 6*b* of the switch regulating plate 6.

The functions and effects of the above second embodiment are basically the same as those of the first embodiment. More specifically, when the depression portion 4*a* of a desired push button 4 is pressed, the abutment portion 4*b* at the tip of the push button 4 first presses substantially vertically down the tip portion 6*b* of the switch regulating plate 6, and the round portion 6*c* extending from the tip portion 6*b* presses down the contact spring 3*a* of the supporting plate 3 in the substantially central direction of the movement 1. The contact portion 3*b* at the tip of the supporting plate 3 is brought into contact with the switch contact portion 2*a* provided at the circuit board 2. The above-described operation of the push button 4 causes an electrical connection with various elements of the electronic components mounted on the movement 1.

The second embodiment differs from the first embodiment in that the tip of the switch regulating plate 6 in the second embodiment extends from the tip portion 6*b* to the round portion 6*c* in the "S" shape. As the tip of the round portion 6*c* faces outward, the switch regulating plate 6 is less likely to intertwine with other regulating plates or components than that of the first embodiment when a plurality of plates 6 are handled together or the plate 6 is handled with other components.

The other effects of the second embodiment are the same as those of the first embodiment. That is, use of the switch regulating plate enables easy placement of the basic circular movement into the square watch case having a different shape. Further, repetitive use of the push button does not cause abnormal wear-off or deformation of the contact spring of the supporting plate. Thus, an inexpensive switch connecting structure with excellent reliability can be provided.

Figure 7:
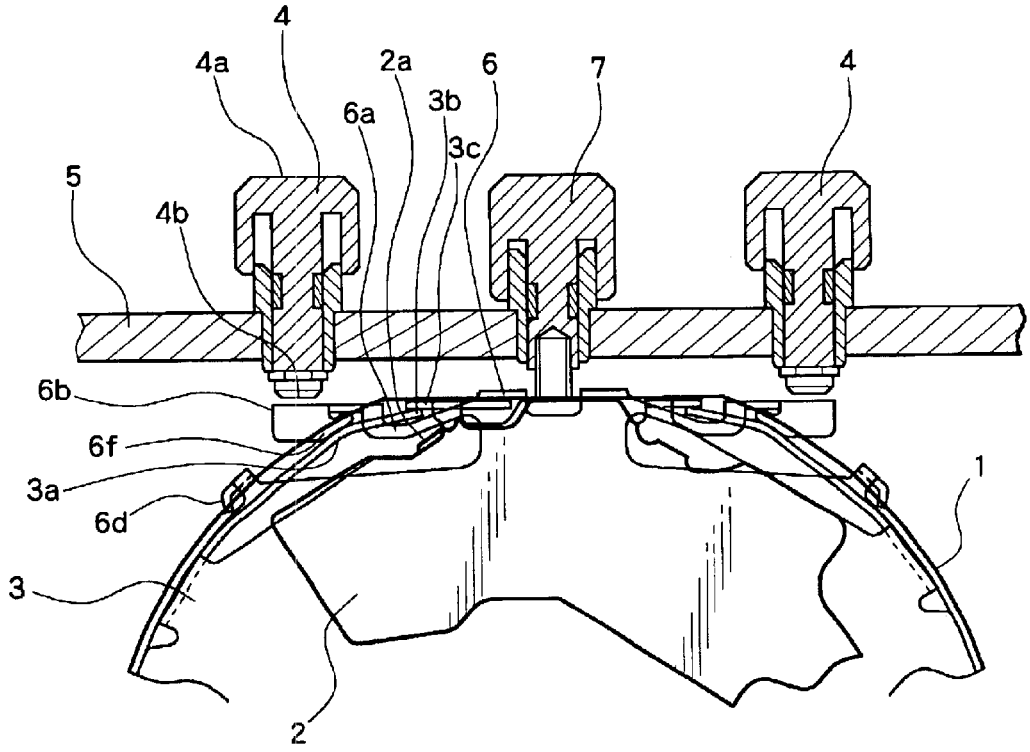
FIG. 7 is a plan view illustrating an important part of a switch connecting structure of the present invention when a circular movement is placed in a square watch case according to a third embodiment. This figure corresponds to FIG. 1.
Figure 8:
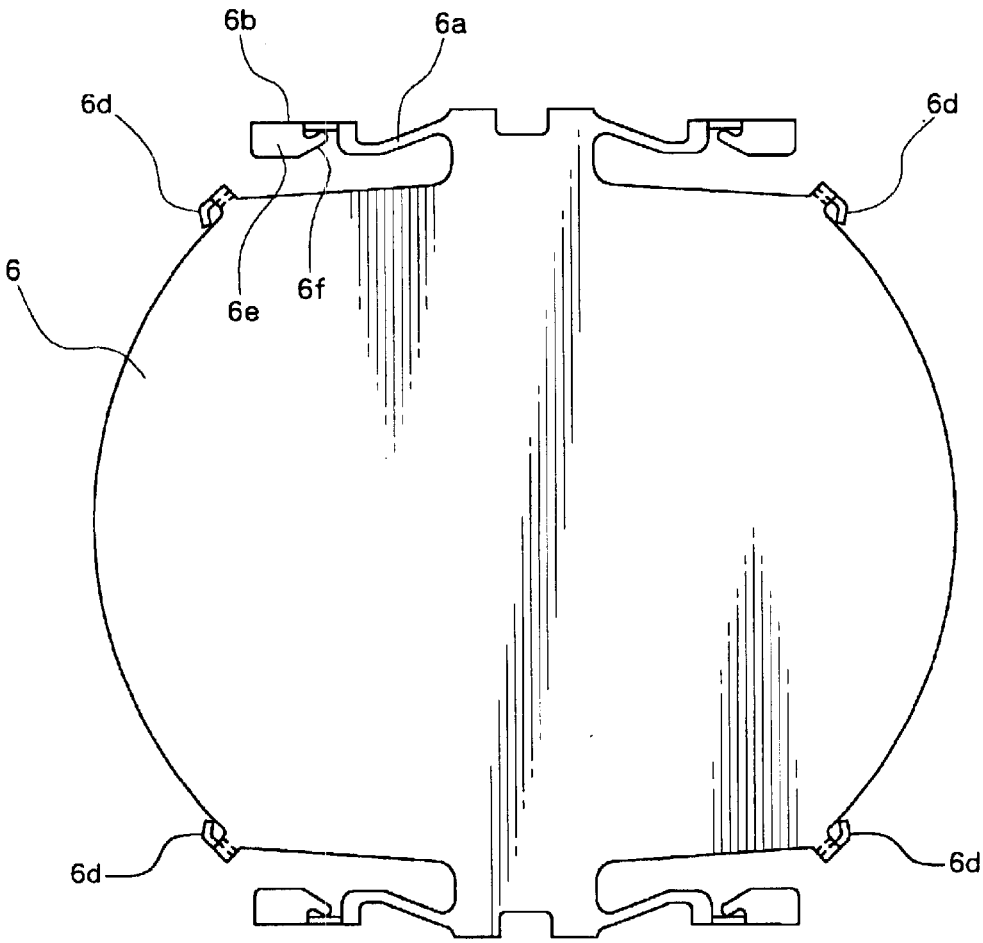
FIG. 8 is a plan view illustrating a switch regulating plate used in the third embodiment.

Next, a third embodiment of a switch connecting structure according to the present invention in which a circular movement is placed into a square watch case will be described with reference to FIGS. 7 and 8. FIG. 7 is a plan view illustrating an important part of the invention, and the push button and the case are shown in cross section as in FIG. 1. FIG. 8 is a plan view illustrating the switch regulating plate. The supporting plate similar to that described with reference to FIG. 2 in the first embodiment is employed in this embodiment.

The components corresponding to those in the related art (FIG. 10) and the first embodiment are labeled with the corresponding numerals and characters.

The supporting plate 3 illustrated in FIG. 2 is attached to cap the circular movement 1. On the outer periphery of the supporting plate 3, the contact spring 3*a* is suspended from the body of the supporting plate 3, extending around the movement and having the contact portion 3*b* at the tip. The tip contact portion 3*b* abuts the restricting portion 3*c* suspended from the body of the supporting plate 3, thereby preventing the supporting plate 3 from springing out. The contact springs 3*a* are formed at four locations in this example along the outer periphery of the supporting plate 3 in the substantially symmetrical manner. The supporting plate 3 is fixed to the movement by screwing, adhesive bonding, or the like.

The switch regulating plate 6 is attached to cap the substantially entire surface of the supporting plate 3. At the outer peripheral location of the switch regulating plate 6 corresponding to the contact spring 3*a* of the supporting plate 3, the switch spring 6*a* is provided in a plane.

The switch spring 6*a* provided at the switch regulating plate 6 extends substantially in parallel to a inside wall of the body of the watch case 5, and the tip portion 6*b* extends from the switch spring 6*a* suspended therefrom. The tip portion 6*b* is formed at a position where it receives and contacts the abutment portion 4*b* of the push button 4 in a plane when the button 4 is pressed. A flat plate portion 6*e* curved from the tip portion 6*b* in the form of a flat plate is horizontally provided to be level with the contact spring 3*a* of the supporting plate 3, and has a corner 6*f* formed in a direction parallel to the contact spring 3*a*. The switch regulating plate 6 is further provided with a plurality (four in FIG. 8) of hook portions 6*d* hooking onto the movement of the watch and disposed substantially equally spaced apart from one another on the outer periphery, suspended from the plate.

The positional relations between these components in the vertical direction are the same as those in the first embodiment. In the plan view as illustrated in FIG. 7, the contact portion 3*b* at the tip of the supporting plate 3 is disposed facing the switch contact portion 2*a* of the circuit board 2, the corner 6*f* of the flat plate portion 6*e* extending from the tip portion 6*b* of the switch regulating plate 6 is disposed so as to abut the central portion of the contact spring 3*a* of the supporting plate 3, and an externally operated component, i.e. the abutment portion 4*b* at the tip of the push button in this example, is disposed so as to abut the tip 6*b* of the switch regulating plate 6.

The functions and effects of the above third embodiment are also basically the same as those of the first embodiment. More specifically, when the depression portion 4*a* of a desired push button 4 is pressed, the abutment portion 4*b* at the tip of the push button 4 first presses substantially vertically down the tip portion 6*b* of the switch regulating plate 6, and the corner 6*f* of the flat plate portion 6*e* extending from the tip portion 6*b* presses the contact spring 3*a* of the supporting plate 3 in the substantially central direction of the movement 1. The contact portion 3*b* at the tip of the supporting plate 3 is brought into contact with the switch contact portion 2*a* provided at the circuit board 2. The above-described operation of the push button 4 causes an electrical connection with various elements of the electronic components mounted on the movement 1.

The third embodiment differs from the first and second embodiments in the shapes of the switch spring 6*a*, the tip portion 6*b*, and the flat plate portion 6*e*. Such shapes enable to reduce the spring width of the switch spring 6*a*, and therefore required pressing force of the push button can be reduced. The other effects of the third embodiment are the same as those of the first embodiment. That is, use of the switch regulating plate enables easy placement of the basic circular movement into the square watch case having a different shape. Further, repetitive use of the push button does not cause abnormal wear-off or deformation of the contact spring of the supporting plate. Thus, an inexpensive switch connecting structure with excellent reliability can be provided.

What is claimed is:

1. A switch connecting structure, comprising:

a supporting plate attached to cap a movement of a timepiece and provided with at least one or more contact springs having a contact portion at a tip brought into contact with a switch contact portion of a circuit board; and a switch regulating plate provided with at least one or more switch springs on an outer periphery corresponding to said contact springs, and covering at least part of said supporting plate; wherein said switch spring is flexed by operation of an externally operated component attached to a timepiece case, thereby bringing the contact portion of the contact spring of said supporting plate into contact with the switch contact portion of said circuit board.

2. A switch connecting structure according to claim 1, wherein a plurality of said switch springs are disposed symmetrically on the outer periphery of said switch regulating plate.

3. A switch connecting structure according to claim 1 or 2, wherein a plurality of hook portions hooking onto said movement of the timepiece are disposed on the outer periphery of said switch regulating plate.

4. A switch connecting structure according to claim 1 or 2, wherein the switch spring of said switch regulating plate extends substantially in parallel to a inside wall of a body of said timepiece case, and has a round portion where it contacts said contact spring.

5. A switch connecting structure according to claim 1 or 2, wherein the switch spring of said switch regulating plate extends substantially in parallel to a inside wall of a body of said timepiece case, and has a corner extending substantially in parallel to said contact spring and provided at a position where it contacts said contact spring.

* * * * *